US007607547B2

(12) United States Patent
Kumata et al.

(10) Patent No.: US 7,607,547 B2
(45) Date of Patent: Oct. 27, 2009

(54) CONTAINER CAP

(75) Inventors: Mitsuo Kumata, Hiratsuka (JP); Hiroomi Matsutani, Hiratsuka (JP); Yuji Tomitaka, Hiratsuka (JP)

(73) Assignee: Japan Crown Cork Co., Ltd., Tokyo (JP)

( * ) Notice: Subject to any disclaimer, the term of this patent is extended or adjusted under 35 U.S.C. 154(b) by 72 days.

(21) Appl. No.: 11/907,669

(22) Filed: Oct. 16, 2007

(65) Prior Publication Data

US 2008/0087625 A1 Apr. 17, 2008

(30) Foreign Application Priority Data

Oct. 17, 2006 (JP) ..... 2006-282552

(51) Int. Cl.
*B65D 41/00* (2006.01)
*B65D 41/34* (2006.01)
*B65D 41/04* (2006.01)

(52) U.S. Cl. ..... 215/252; 215/305; 215/329

(58) Field of Classification Search ..... 215/252, 215/305, 329, 901, 295
See application file for complete search history.

(56) References Cited

U.S. PATENT DOCUMENTS 4,241,841 A * 12/1980 Boller ..... 215/252
4,540,099 A * 9/1985 Swartzbaugh et al. ..... 215/252
4,638,917 A * 1/1987 Persch ..... 215/252
4,727,998 A * 3/1988 Simon ..... 215/230
5,273,173 A * 12/1993 Debetencourt ..... 215/252
5,397,009 A * 3/1995 Salmon et al. ..... 215/252
5,552,117 A * 9/1996 Burns ..... 422/102
6,095,358 A * 8/2000 Marino ..... 215/330
6,609,287 B2 * 8/2003 Evans et al. ..... 29/451
2001/0027957 A1 * 10/2001 Kano ..... 215/341
2005/0161425 A1 * 7/2005 Morini ..... 215/204

FOREIGN PATENT DOCUMENTS

DE 100 34 608 A1 5/2001
GB 2269372 A * 2/1994
JP 2001-354247 12/2001
JP 2005-178828 7/2005

* cited by examiner

*Primary Examiner*—Anthony D Stashick
*Assistant Examiner*—Niki M Eloshway
(74) *Attorney, Agent, or Firm*—Sughrue Mion, PLLC

(57) ABSTRACT

A container cap which offers improved opening/closing performance and improved touch feeling. Linear protuberances are formed on the circumferential wall of the main portion of the skirt of the container cap of the container. The protuberances include large protuberances having a large height and small protuberances having heights of protrusion from the outer surface of the circumferential wall portion smaller than that of the large protuberances. The main portion has large protuberance regions forming a plurality of large protuberances and small protuberance regions forming a plurality of small protuberances, the large protuberance regions and the small protuberance regions being alternately arranged in the circumferential direction of the main portion.

7 Claims, 8 Drawing Sheets

CONTAINER CAP

BACKGROUND OF THE INVENTION

1. Field of the Invention

The present invention relates to a container cap which is fitted to the mouth-and-neck portion of a container containing such a liquid as a beverage, a detergent or a chemical agent, and which offers good touch feeling at the time when it is to be opened or closed.

2. Description of the Related Art

A container cap of a container for containing coffee or carbonated beverage has linear protuberances (vertical ribs, often called knurling in this field of art) extending in the up-and-down direction and formed on the so-called skirt wall corresponding to the circumferential wall portion of a cylindrical shape with bottom. The protuberances are so formed that the fingers will not slip at the time of opening or closing the container cap.

Protuberances of the same shape and of the same height are usually formed on the container cap. For easier opening and closing of the container cap, however, a technology has been proposed as disclosed in JP-A-2001-354247. According to this technology, the linear protuberances extending in the up-and-down direction of the skirt wall include two kinds of protuberances, i.e., tall protuberances (hereinafter referred to as large protuberances) and short protuberances (hereinafter referred to as small protuberances), the large protuberances and the small protuberances being alternately arranged along the whole circumference of the skirt wall of the container cap in the circumferential direction thereof. This improves the catch by fingers at the time of opening or closing the container cap; i.e., the opening/closing performance of the container cap can be improved.

OBJECT AND SUMMARY OF THE INVENTION

In a state where large protuberances and small protuberances are alternately arranged as in the technology of above JP-A-2001-354247, catching by fingers (opening/closing performance) decreases if a difference in the height is small between the large protuberances and the small protuberances. If a difference in the height is large between the large protuberances and the small protuberances, on the other hand, tough feeling (contact feeling) will often be such that the ends of the large protuberances bite into the inner surfaces of the fingers at the time of opening or closing the container cap causing a pain. With the container cap provided with a tamper-evidence band, in particular, when the user is going to open the cap, first, after having purchased the beverage, the bridging portion of the tamper-evidence band must be broken requiring a larger force than that of usually opening the cap, and the protuberance may bite more into the finger tips.

According to JP-A-2001-354247, heights of the large protuberances and small protuberances, and a pitch between the large protuberance and the small protuberance, are adjusted to improve opening/closing performance of the container cap as well as to improve the touch feeling at the time of opening and closing. With the shape in which the large protuberances and the small protuberances are alternately arranged, however, limitation is imposed on improving the opening/closing performance and improving the touch feeling.

The present invention was accomplished in view of the above circumstances and its object is to provide a container cap which offers improved opening/closing performance and improved touch feeling.

In order to achieve the above object, the present invention provides a container cap comprising a top panel wall and a skirt wall of a cylindrical shape hanging down from the circumferential edge of the top panel wall, the skirt wall being sectioned into a main portion over a weakened line that is extending in the circumferential direction and can be broken and a tamper-evidence hem under the weakened line, and the circumferential wall portion of at least the main portion of the skirt wall having linear protuberances protruding on the outer side of the circumferential wall portion and extending in the up-and-down direction of the main portion in a plural number along the whole circumferential direction of the main portion, wherein the protuberances include large protuberances having a large height and small protuberances having a height of protrusion from the outer surface of the circumferential wall portion smaller than that of the large protuberances, and the main portion has large protuberance regions forming a plurality of large protuberances and small protuberance regions forming a plurality of small protuberances, the large protuberance regions and the small protuberance regions being alternately arranged in the circumferential direction of the main portion.

The protuberances formed on the small protuberance regions of the container cap are such that the small protuberances at positions close to the middle side of the small protuberance regions in the circumferential direction have a height of protrusion from the outer surface of the circumferential wall portion smaller than the height of protrusion of the small protuberances positioned on the outer sides.

In the small protuberance regions, it is desired that the height of protrusion of the small protuberances gradually decreases toward the middle side from the outer sides in the circumferential direction.

In the container cap, the large protuberance regions and the small protuberance regions can be so arranged that the angles thereof in the circumferential direction are not smaller than 10 degrees but are not larger than 45 degrees.

In the container cap, it is desired that the inner surface of the circumferential wall portion of the main portion is internally threaded to come into engagement with the mouth-and-neck portion of the container, the internal thread forming a threaded portion having a screw thread and a plurality of missing portion where the screw thread is missing, the threaded portion being arranged on the inner surface of the circumferential wall portion of at least the small protuberance regions, and at least the large protuberance regions being arranged on the outer surface of the circumferential wall portion at the missing portions.

DETAILED DESCRIPTION OF PREFERRED EMBODIMENTS

A container cap according to a first embodiment of the present invention will now be described with reference to the drawings.

Figure 1:
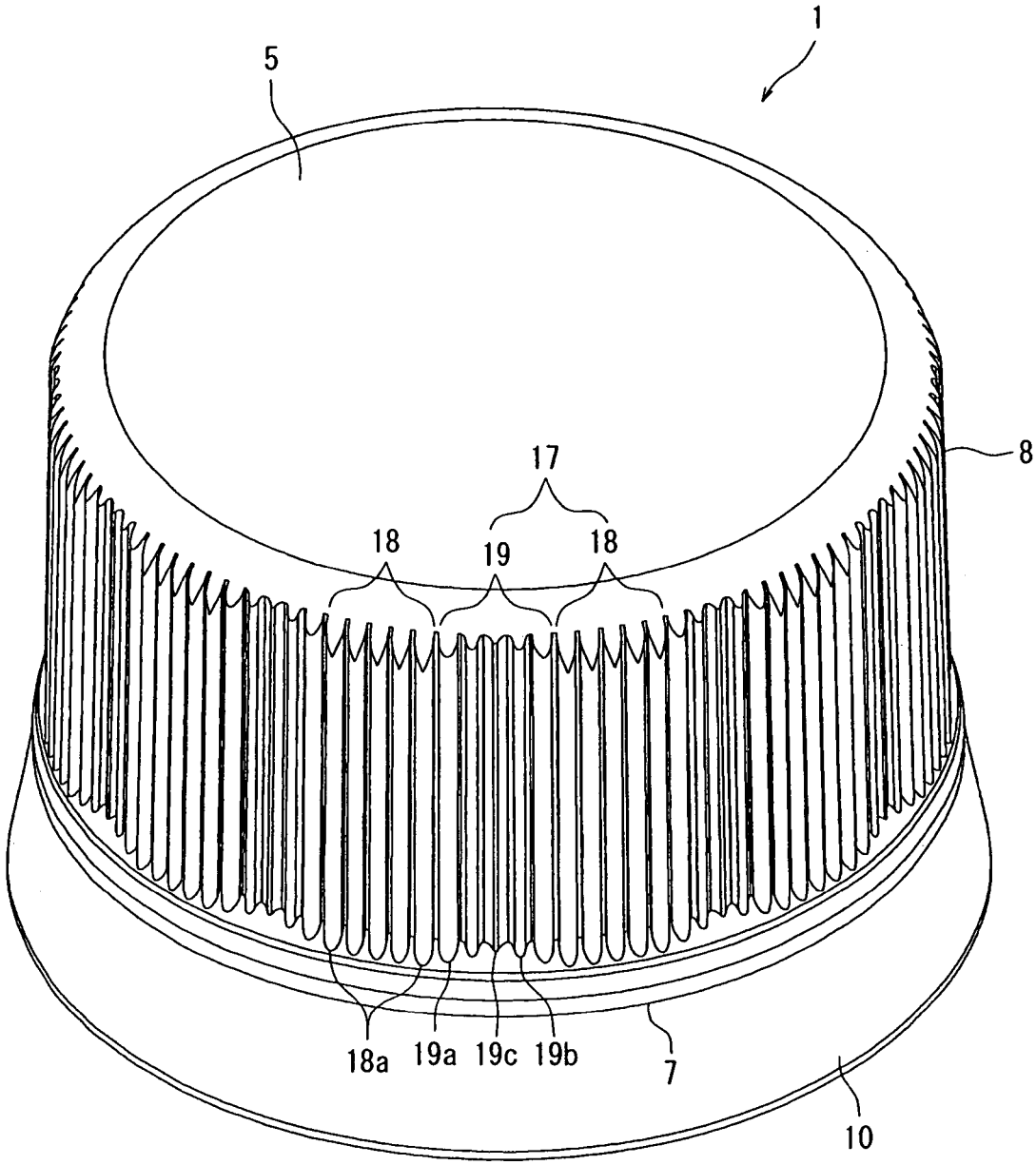
FIG. 1 is a perspective view of a container cap according to a first embodiment of the present invention.
Figure 2:
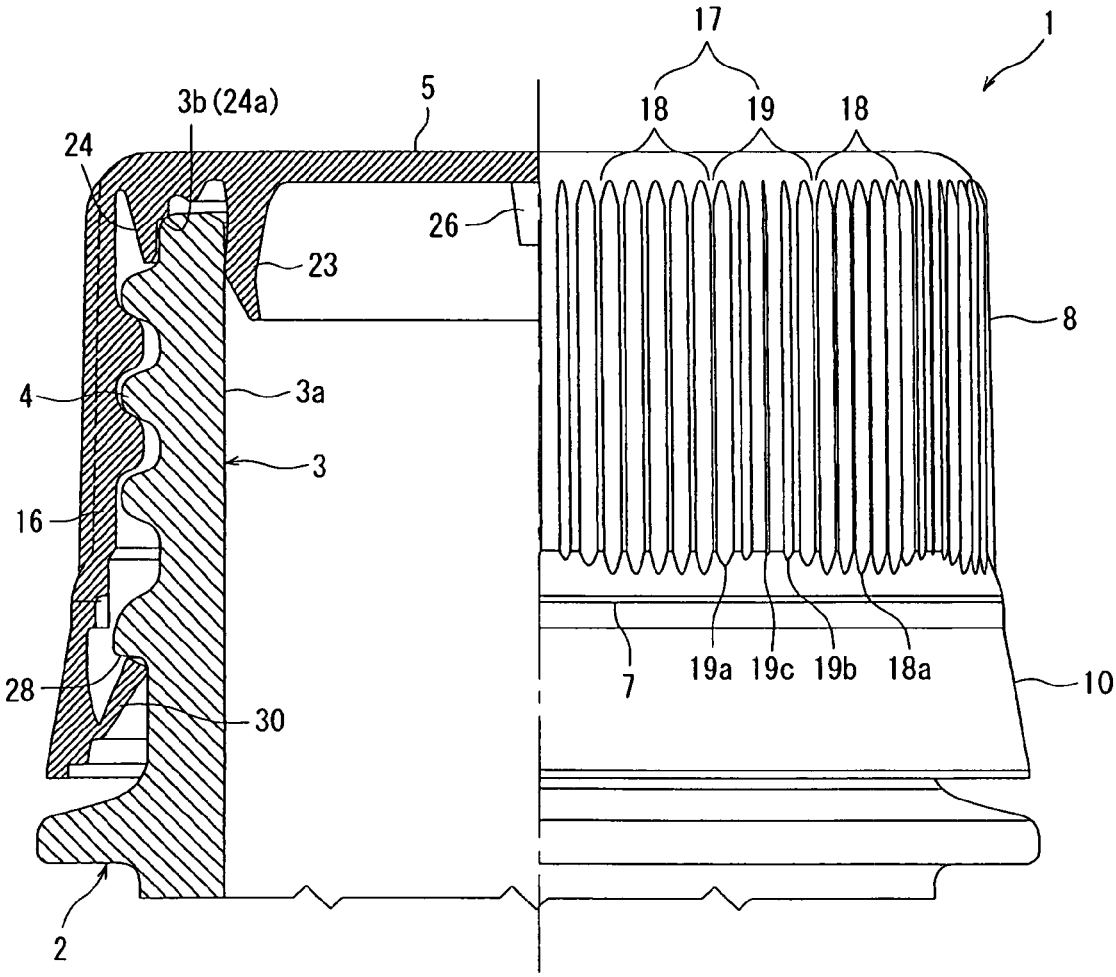
FIG. 2 is a view illustrating the container cap of the present invention engaging with a container, wherein the right side of the center line in the drawing is a front view of the container cap, and the left side is a sectional view thereof.

FIG. 1 is a perspective view of a container cap 1 according to the present invention, and FIG. 2 is a view wherein the right side of the center line is a front view of the container cap 1 and the left side is a sectional view of the container cap 1.

The container cap 1 is formed by using a synthetic resin such as polyethylene or polypropylene. The container cap 1 has a top panel wall 5 of the shape of a disk and a skirt wall 6 of nearly a cylindrical shape hanging down from the circumferential edge of the top panel wall 5. The circular top panel wall 5 of the container cap 1 extends as a whole substantially horizontally, and a weakened line 7 is formed in the lower part of the skirt wall 6 extending in the circumferential direction. The skirt wall 6 has a main portion 8 over the weakened line 7 and a tamper-evidence hem 10 under thereof.

The circumferential weakened line 7 is constituted by slits 12 formed maintaining a gap in the circumferential direction and bridging portions 14 present among the slits 12. The bridging portions 14 couple the main portion 8 and the hem 10 together in the up-and-down direction, and have a length in the circumferential direction very shorter than the length of the slits 12 in the circumferential direction, so as to be easily broken.

The main portion 8 of the skirt wall 6 is forming a cylindrical circumferential wall portion 16 of an equal thickness and a plurality of protuberances 17 protruding outward from the circumferential wall portion 16 in the radial direction. The protuberances 17 are of a linear (rib-like) shape linearly extending in the up-and-down direction of the skirt wall 6, and are formed along the whole circumference of the main portion 8.

Figure 3:
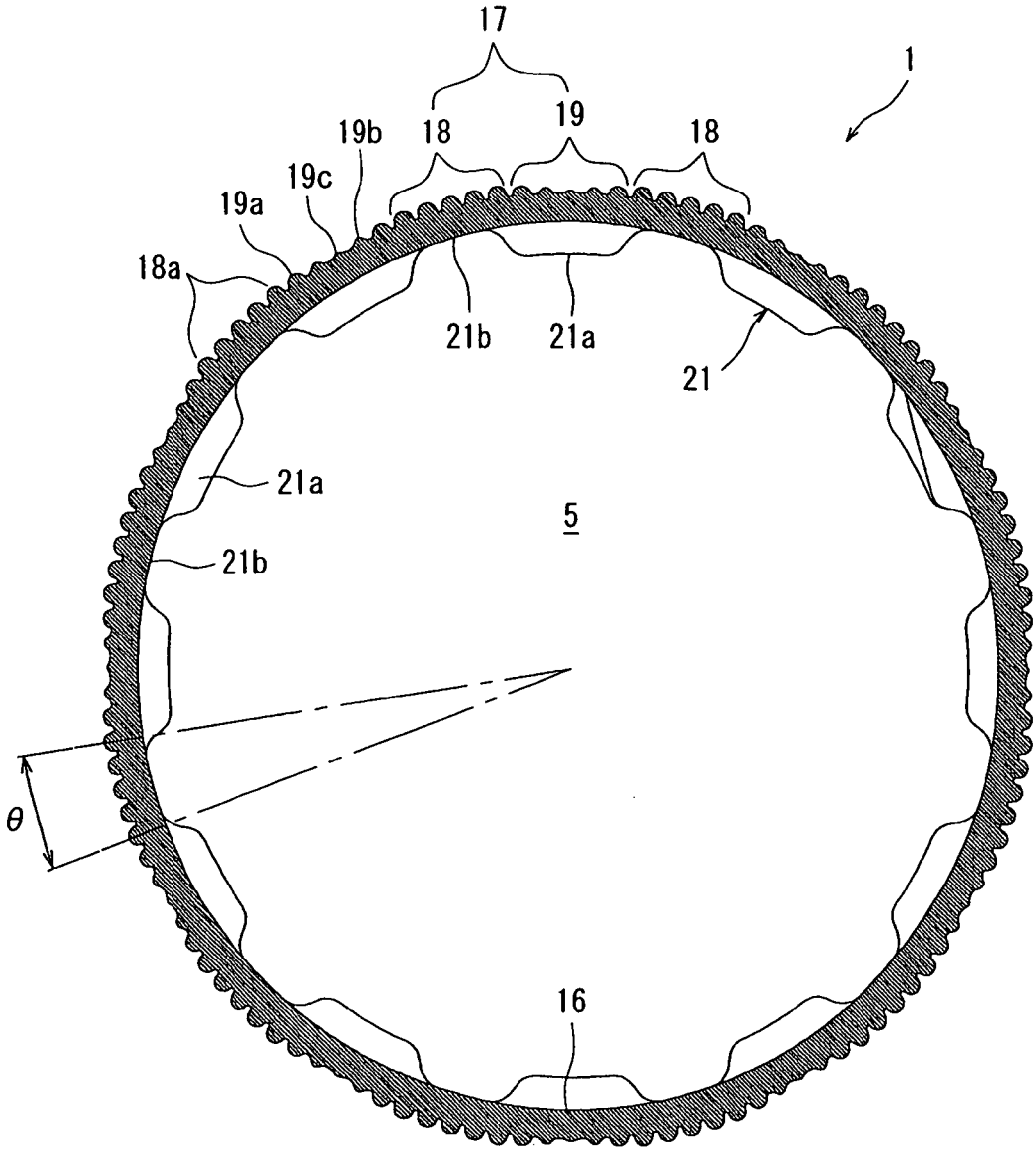
FIG. 3 is a sectional view of when the container cap is cut in the direction of a line X-X in FIG. 4.

Referring to FIG. 3 which is a sectional view cutting the container cap 1 in the horizontal direction, the protuberances 17 include large protuberances 18*a* having a large height and small protuberances 19*a* to 19*c* having heights smaller than that of the large protuberances 18*a*. The large protuberances are nearly of a semicircular shape in cross section. The large protuberances 18*a* of the same shape are arranged maintaining the same pitch and, in this embodiment, continuously in a number of five. A region in which the large protuberances are continuously arranged in a number of five is hereinafter referred to as a large protuberance region 18. The large protuberance regions 18 constituted in the same shape are arranged in a plural number maintaining an equal distance in the circumferential direction of the main portion 8. The angle of the large protuberance region 18 in the circumferential direction is preferably in a range of 10 degrees to 45 degrees.

Small protuberance regions 19 are formed among the large protuberance regions 18 of the main portion 8. In the small protuberance region 19, small protuberances 19*a* to 19*c* of heights smaller than that of the large protuberances 18*a* are protruding from the circumferential wall portion 16. Among the small protuberances 19*a* to 19*c* in the small protuberance region 19, the two small protuberances 19*a* positioned on the most outer sides have a height smaller than the height of the large protuberances 18*a*. The two inner small protuberances 19*b* positioned on the insides of the outer small protuberances 19*a* have a height smaller than the height of the outer small protuberances 19*a*. The central small protuberance 19*c* at the center in the small protuberance region 19 on the insides of the inner small protuberances 19*b* has a height which is smaller than the height of the inner small protuberances 19*b*. The outer small protuberances 19*a*, inner small protuberances 19*b* and the central small protuberance 19*c* are formed maintaining a pitch in the circumferential direction equal to the pitch among the large protuberances 18*a* in the circumferential direction. Therefore, the angle of the large protuberance region 18 in the circumferential direction and the angle of the small protuberance region 19 in the circumferential direction are in agreement in this embodiment. However, the pitches of the large protuberance regions 18 and of the small protuberance regions 19 do not necessarily have to be in agreement with each other but may be suitably varied.

In the large protuberance region 18, the large protuberances 18*a* are protruding by the same height from the outer surface of the circumferential wall portion 16. In the small protuberance region 19, the small protuberances 19*a*, 19*b* and 19*c* are arranged in this order from the outer side toward the middle side of the small protuberance region 19, and the height of protrusion from the outer surface of the circumferential wall portion 16 is gradually decreasing in order of small protuberances 19*a*, 19*b* and 19*c*. In the main portion 8, therefore, the large protuberance regions 18 have a large thickness due to the presence of large protuberances 18*a*, and the small protuberance regions 19 have a small thickness due to the small protuberances 19*a*, 19*b*, 19*c* having heights smaller than that of the large protuberances 18*a*.

Figure 4:
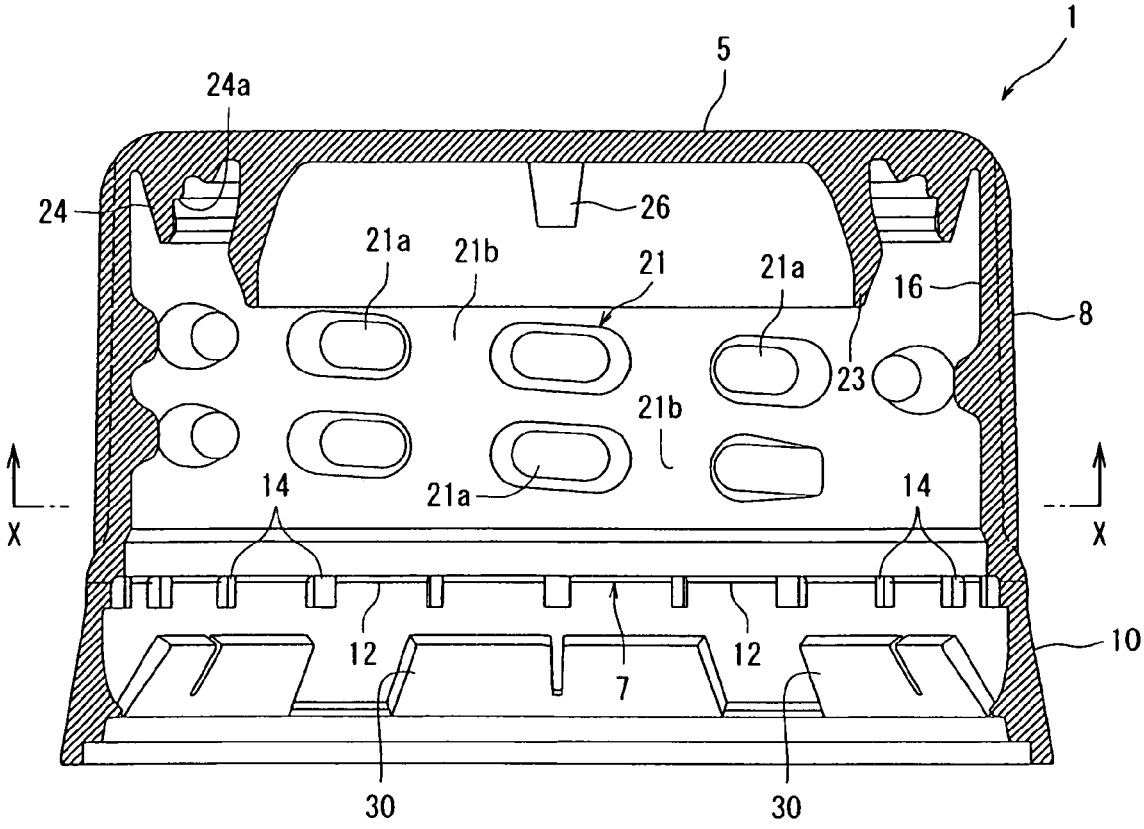
FIG. 4 is a sectional view of when the container cap of FIG. 1 is cut in the vertical direction.

Referring to FIG. 2, the outer periphery of the mouth-and-neck portion 3 of the container 2 is externally threaded as designated at 4, and the inner peripheral surface of the main portion 8 of the skirt wall 6 of the container cap 1 is internally threaded as designated at 21 to be screw-fitted to the external thread 4. Referring to FIG. 4, a screw thread of the internal thread 21 formed in the container cap 1 is so formed as to mildly and helically extend along the inner circumferential wall of the main portion 8, and includes the portions with threaded portion 21*a* and the missing portions 21*b* without the threaded portion 21*a*. Referring to FIG. 3, the portions with the threaded portion 21*a* are arranged facing the positions on the inner circumferential surface of the main portion 8 where the small protuberance regions 19 are present. The missing portions 21*b* without the threaded portion 21*a* are arranged facing the portions on the inner circumferential surface of the main portion 8 where the large protuberance regions 18 are present.

Referring to FIG. 2, an annular seal 23 is formed on the inner surface side of the top panel wall 5 but on the outer side in the radial direction, the annular seal 23 protruding downward from the top panel wall 5. An annular lip 24 is formed on the further outer side in the radial direction of the top panel wall 5, the annular lip 24 similarly protruding downward from the top panel wall 5. The annular seal 23 maintains sealing as its outer circumferential surface comes in contact with the inner circumferential surface 3*a* of the mouth-and-neck portion 3 of the container 2.

The annular lip 24 forms a step 24*a* of an inversely stepped shape on the side of the inner circumference thereof, the step

24*a* being formed at a position corresponding to a shoulder portion 3*b* of the mouth-and-neck portion 3 to play the role of bringing the container cap 1 into the position of the mouth-and-neck portion 3.

Figure 5:
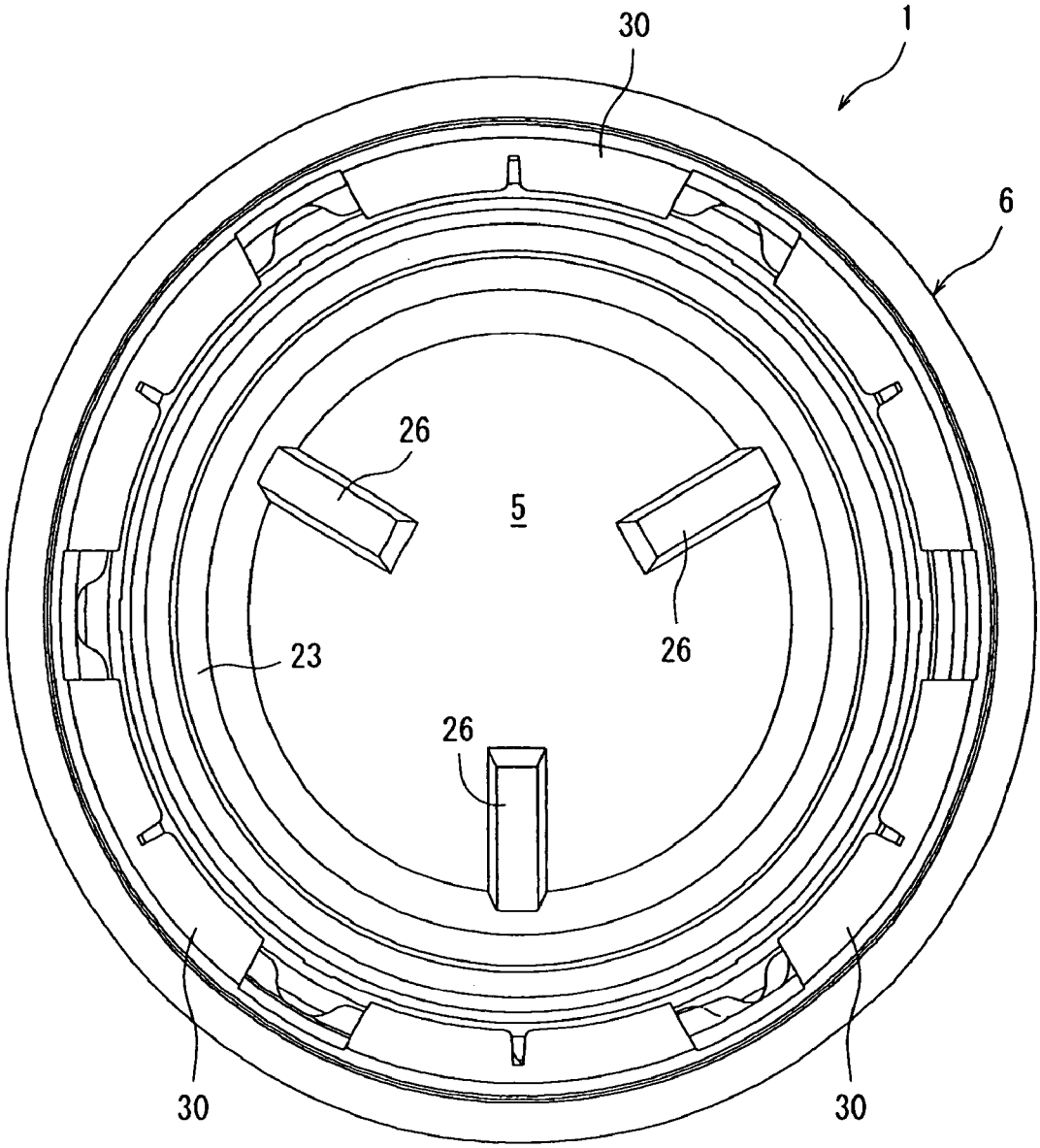
FIG. 5 is a bottom view of the container cap of FIG. 1.

FIG. 5 is a bottom view of the container cap 1, wherein ribs 26 are formed on the inner surface of the top panel wall 5 toward the inside in the radial direction from the inner circumferential surface of the annular seal 23. The ribs 26 are formed at three places maintaining an equal angular distance (120 degrees). In a state where the pressure increases in the container 2, for example, the central portion of the top panel wall 5 of the container cap 1 may expand upward of the container 2. The ribs 26 are coupled at their base ends to the annular seal 23. In this case, the ribs 26 that move accompanying the motion of the top panel wall 5 work to deform the annular seal 23 in a direction to release the sealing enabling the interior of the container 2 to be vented.

Plate-like flaps 30 of a rectangular shape are coupled to the lower side on the inner circumferential surface of the hem 10 of the container cap 1, and are so formed that the end sides thereof are directed upward and aslant toward the inner circumferential surface side of the container cap 1. The base end side of the flap 30 which is a portion coupling to the container cap 1 plays the role of a hinge, and the flap 30 is provided with flexibility due to the elasticity of the resin. Referring to FIGS. 4 and 5, the flaps 30 are formed on the inner circumferential surface of the hem 10 maintaining a gap in the circumferential direction of the hem 10. Referring to FIG. 2, an engaging portion 28 having a surface facing downward is formed in the lower part of the external thread 4 on the outer circumferential surface of the mouth-and-neck portion 3 of the container 2, the engaging portion 28 protruding outward of the container 2. After having climbed over the engaging portion 28 in its folded state at the time of closing the container cap 1, the flaps 30 have their ends directed toward the center side of the container 2 so as to be arranged under the lower surface of the engaging portion 28.

To open the container cap 1, a user grips the container by his one hand and opens the container cap by the fingers of the other hand. Upon turning the main portion 8, the container cap 1 as a whole moves up due to the action of the external and internal threads 4, 21. Here, however, the flaps 30 provided for the tamper-evidence hem 10 are engaged with the engaging portion 28 of the container 2 and, therefore, the side of the main portion 8 only moves upward. The bridging portions 14 of the weakened line 7 are broken due to the motion of the main portion, and the side of the main portion 8 is separated away from the mouth-and-neck portion 3 of the container 2 with the weakened line 7 as a boundary.

To separate the weakened line 7, a force larger than that of usually opening the cap is required. In this embodiment, however, the large protuberance regions 18 and the small protuberance regions 19 are alternately formed along the circumference of the main portion 8 of the container cap 1. The user touches the main portion 8 by his fingers and exerts a large force without finding his finger tips slipping. That is, upon touching the large and small protuberance regions 18, 19 by hand, the user feels smooth contact feeling. According to the container cap 1 of this embodiment as described above, a mildly undulating curve is described by the ends of large protuberances 18*a* of the large protuberance regions 18 and by the ends of the small protuberances 19*a* to 19*c* of the small protuberance regions 19, preventing a painful and biting finger touch when the large protuberance regions 18 and the small protuberance regions 19 are pushed by finger tips. Even after the weakened line 7 has been cut off, the container cap 1 can be favorably opened or closed offering good contact feeling.

In this embodiment, the large protuberances 18*a* are of an ordinary height and the small protuberances 19*a* to 19*c* are protruding less than the large protuberances 18*a*. Therefore, the thickness of the main portion (skirt wall 6) 8 can be decreased by an amount the small protuberances 19*a* to 19*c* are protruding less, contributing to reducing the weight of the container cap 1 and the material cost. It is, on the other hand, probable that the container cap 1 locally lose the strength by an amount the thickness of the small protuberance regions 19 is decreased. To cope with this as shown in FIG. 3, threaded portions 21*a* are formed in the internal thread 21 so as to be corresponded to the small protuberance regions and missing portions 21*b* are formed in the internal thread 21 so as to be corresponded to the large protuberance regions 18 having a large rigidity. In the container cap 1 as described above, the threaded portions 21*a* and the missing portions 21*b* are suitably arranged maintaining balance in the strength of the container cap, improving cooling efficiency in forming the container cap 1, maintaining balance in the parting resistance and suppressing slack in the thread.

The container cap 1 is held by a holding fitting (not shown) at the time of filling beverage or the like, and is wrap-seamed with the container 2 with a predetermined force and a rotational torque. At this moment, the rugged shape of the plurality of protuberances 17 engages with the holding fitting preventing the slipping at the time of wrap-seaming the container cap 1. The holding fitting is caught by the protuberances 17 without problem and no dispersion occurs in the angle of wrap-seaming.

The flaps 30 are formed on the hem 10 of the skirt wall 6 of the container cap 1 maintaining a gap in the circumferential direction. Here, the flaps 30 may be formed being corresponded to the small protuberance regions 19 while forming no flap 30 for the large protuberance regions 18 to reinforce the rigidity of the small protuberance regions 19.

Next, a second embodiment of the invention will be described.

Figure 6:
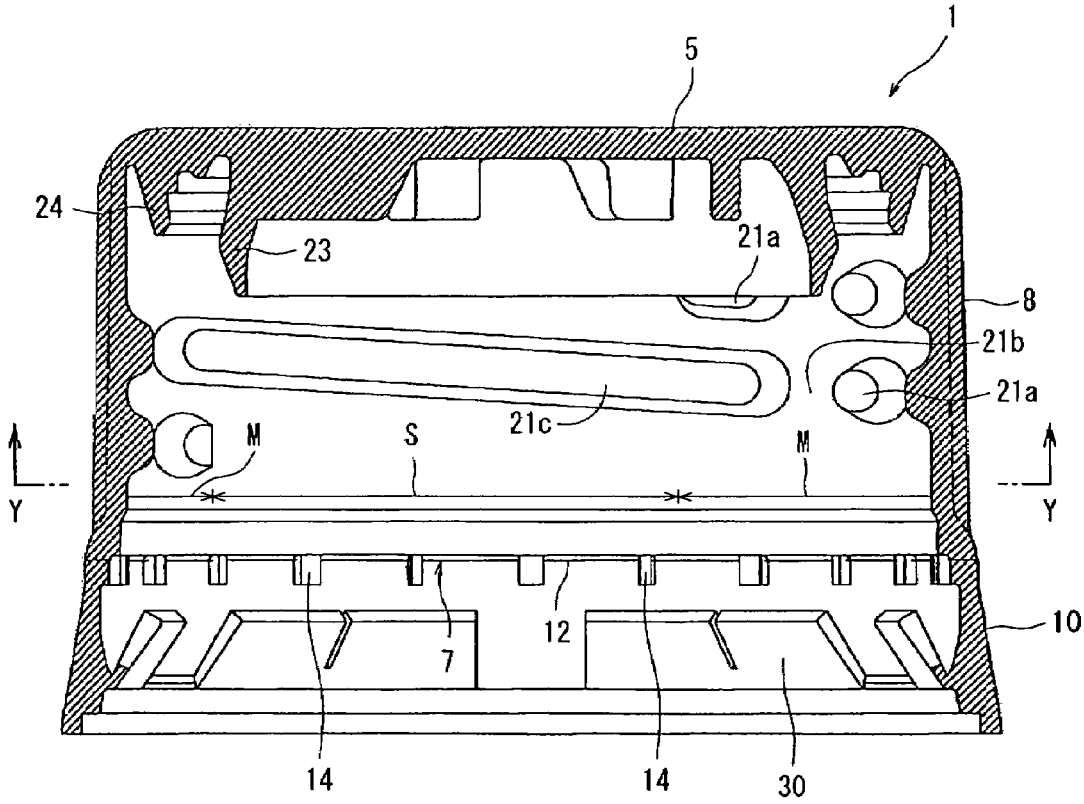
FIG. 6 is a side view of the container cap according to a second embodiment of the present invention.
Figure 7:
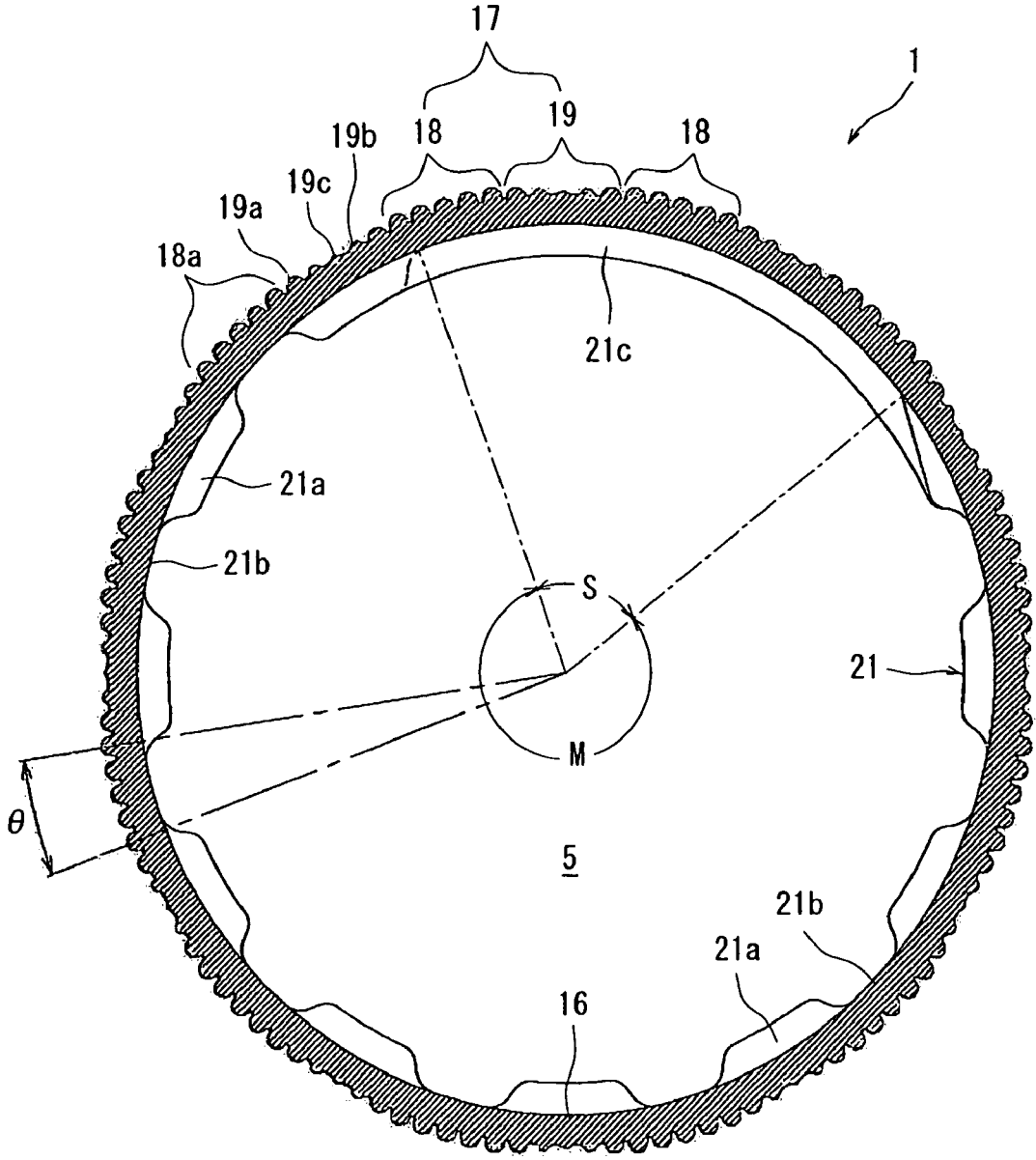
FIG. 7 is a sectional view of the container cap in the direction of a line Y-Y in FIG. 6, omitting the top panel wall.

FIG. 6 is a side view of the container cap according to a second embodiment, and FIG. 7 is a sectional view of the container cap in the direction of a line Y-Y in FIG. 6, omitting the top panel wall. The same portions as those of the above embodiment are denoted by the same reference numerals.

In the above first embodiment as shown in FIG. 3, threaded portions 21*a* are formed in the internal thread 21 so as to be corresponded to the small protuberance regions 19 and missing portions 21*b* are formed in the internal thread 21 so as to be corresponded to the large protuberance regions 18 having a large rigidity to maintain balance in the strength of the container cap 1.

However, in case, when, for example, the thread is turned by 1.5 turns in the circumferential direction, there occur a portion where the internal threads are present being overlapped in the up-and-down direction and a portion where the internal thread is simply present without overlapping. In such a case, if a missing portion is formed in the portion where the thread is present without overlapped, it is probable that the rigidity of the missing portion becomes smaller than other portions. In the second embodiment, the balance of rigidity is taken into consideration.

In the container cap 1 of this embodiment as shown in FIGS. 6 and 7, the internal thread 21 helically formed in the inner surface of the container cap 1 is provided with a circumferential thread-overlapped region M in which the threads are doubly overlapped in the up-and-down direction of the container cap 1 and a circumferential single-thread portion S in which only one thread is present without overlapped. In the circumferential single-thread region S, screw threads have not been doubly formed up and down. Therefore, the circumferential single-thread region S has a rigidity smaller than that of the circumferential thread-overlapped region M.

In this embodiment, therefore, a continuously threaded portion 21*c* is formed over the circumferential single-thread region S without forming missing portion 21*b* irrespective of the small protuberance regions 19 or the large protuberance regions 18. If described in further detail, the screw thread is formed from one end (starting end) of the internal thread 21 where the internal thread 21 has not been formed up to the circumferential single-thread region S which is the other end (terminating end) thereof. In this embodiment, further, the continuously threaded portion 21*c* is formed up to the threaded portions 21*a* adjacent to both ends of the circumferential single-thread region S.

This prevents the container cap 1 from locally losing the rigidity in the circumferential direction at the threaded portions where the number of overlappings (number of turns) of the thread in the circumferential direction cannot be divided by a positive number.

Next, described below is an experiment of the container cap of the invention.

In an Experiment 1, the opening function of the container cap, capping aptitude and weight were tested depending upon the arrangement of the large protuberances and the small protuberances shown in FIG. 3 and upon the presence of small protuberances. The opening function of the container cap compared the catching performance (opening performance) of the container cap at the time when it was opened and the feeling (contact feeling) of protuberances 17 that bit into the fingers at the time of gripping the container cap. The capping aptitude compared if the holding fitting engaged with the protuberances 17 could stably close the container cap without undergoing slipping at the time when the container was wrap-seamed with the container cap by the holding fitting with a predetermined force and a rotational torque.

Figure 8:
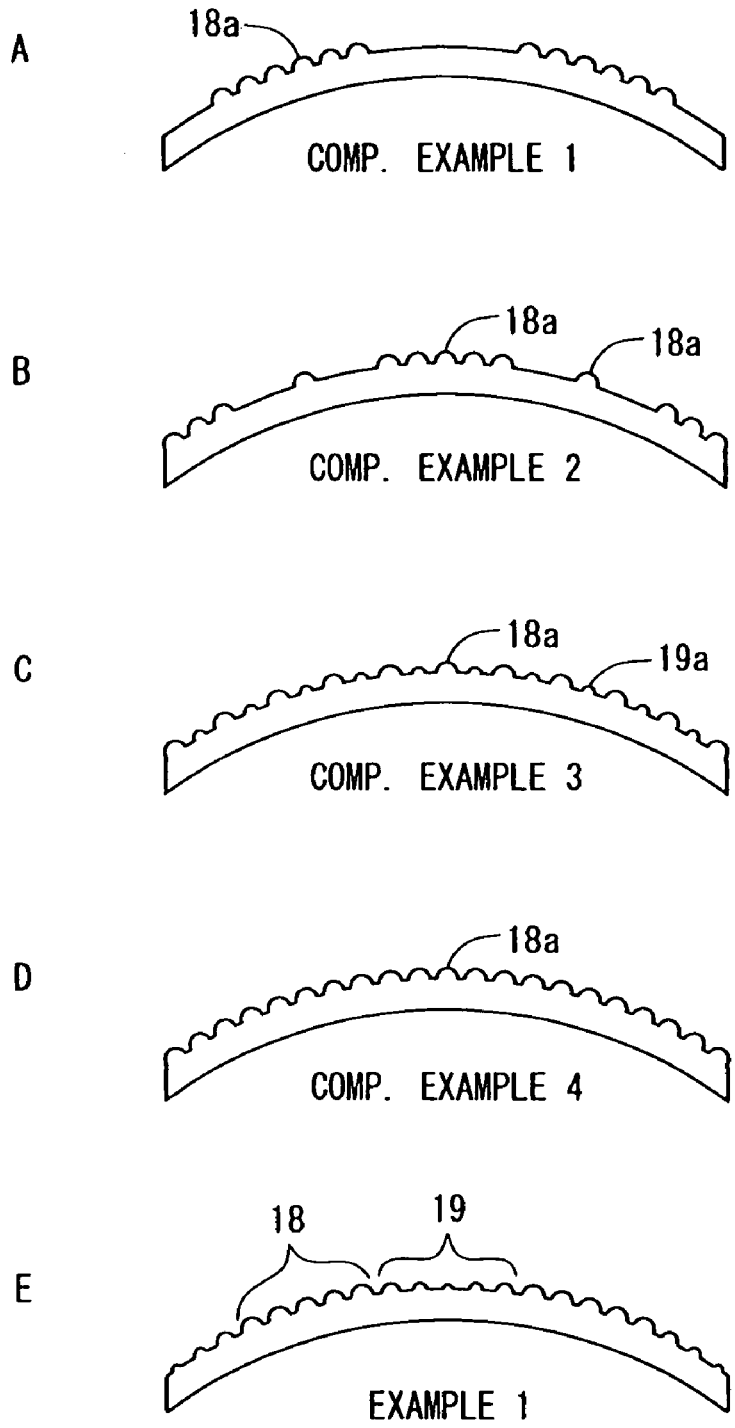
FIG. 8A is a sectional view of the shape of protuberances of Comparative Example 1.
FIG. 8B is a sectional view of the shape of protuberances of Comparative Example 2.
FIG. 8C is a sectional view of the shape of protuberances of Comparative Example 3.
FIG. 8D is a sectional view of the shape of protuberances of Comparative Example 4.
FIG. 8E is a sectional view of the shape of protuberances of Example 1, which are in an Experiment 1.

In Comparative Example 1, a container cap was formed by forming, as shown in FIG. 8A, six large protuberances 18*a* and forming no protuberance among the large protuberance regions 18. In Comparative Example 2, a container cap was formed by forming, as shown in FIG. 8B, five large protuberances 18*a* and a large protuberance 18*a* at the central portions among the large protuberance regions 18. In Comparative Example 3, a container cap was formed by alternately forming the large protuberances 18*a* and the small protuberances 19*a* as shown in FIG. 8C. In Comparative Example 4, a container cap was formed by uniformly arranging the large protuberances 18*a* over the whole circumference of the main portion of the skirt wall as shown in FIG. 8D. In Example 1, as shown in FIG. 8E, the large protuberance regions 18 and the small protuberance regions 19 which were the same as those of the embodiments of FIGS. 1 to 5 were alternately formed surrounding the main portion of the skirt wall.

The results of test were as shown in Table 1.

TABLE 1

| | | Opening function | | | |
|---|---|---|---|---|---|
| | Shape of protuberance | Opening performance | Contact feeling | Capping aptitude | Weight |
| Comp. Ex. 1 | 6 crests/ 0 crest | ◎ | Δ | ○ | ◎ |
| Comp. Ex. 2 | 5 crests/ 1 crest | ○ | Δ | Δ | ○ |
| Comp. Ex. 3 | alternate | Δ | ○ | ○ | Δ |
| Comp. Ex. 4 | uniform 120 crests | Δ | ◎ | ◎ | Δ |
| Ex. 1 | undulating | ◎ | ◎ | ○ | ○ |

Decreasingly favorable in order of ◎, ○, Δ.

As for ◎, ○ and Δ representing the evaluation in Table 1, ◎ represents the most high evaluation followed by other evaluations. Here, however, Δ is not to mean that the container cap cannot be used.

The results of testing tell that when the large protuberance regions were formed but no protuberance among the large protuberance regions as in Comparative Example 1, the opening performance was evaluated to be high at the time of opening and closing, but a difference in the ruggedness was so large that the contact feeling at the time of gripping the skirt wall was evaluated to be poor. In Comparative Example 4 of the ordinary container cap having large protuberances uniformly formed thereon, the catching was weak at the time of opening, and the opening performance at the time of opening and closing was evaluated to be poor though the contact feeling was highly evaluated without causing pain to the finger tips at the time of gripping. In Comparative Examples 2 and 3, the container caps were not particularly highly evaluated. In Example 1, both the opening performance and contact feeling at the time of opening and closing were highly evaluated.

Next, as Experiment 2, the opening performance of the container cap and the touch feeling upon opening were tested by varying the angle θ of large protuberances in the circumferential direction at both end positions of the large protuberance regions shown in FIG. 3.

The conditions of the container cap were as described below. That is, the small protuberance regions possessed the same protuberance shape (five protuberances) as that of the above Example, and the angle θ in the circumferential direction was varied by increasing or decreasing the number of the large protuberances without varying the pitch among the large protuberances in the large protuberance region. The angle of one pitch between the large protuberances or between the small protuberances was 3 degrees in the circumferential direction (120 crests as a whole). Referring to FIG. 3, the angle θ of the large protuberance region in the circumferential direction is 12 degrees since the large protuberances include 4 pitches (Example 3).

By using the same container, the container caps were opened and closed, the container caps including the one having an angle θ in the circumferential direction of 6 degrees (3 crests) in Example 2, the one having an angle θ of 12 degrees (5 crests) in Example 3, the one having an angle θ of 27 degrees (10 crests) in Example 4, the one having an angle θ of 42 degrees (15 crests) in Example 5 and the one having an angle θ of 57 degrees (20 crests) in Example 6, in order to examine the catching of the container cap by the finger tips (opening performance), bite of protuberances into the fingers at the time of opening or closing, contact feeling (contact feeling for opening) and weight of the container cap.

The results were as shown in Table 2.

TABLE 2

| | Angle of arrangement | Opening function: Opening performance | Opening function: Touch feeling | Opening function: Capping aptitude | Weight |
|---|---|---|---|---|---|
| Ex. 2 | θ = 6° | ◎ | ○ | Δ | ○ |
| Ex. 3 | θ = 12° | ◎ | ◎ | ○ | ○ |
| Ex. 4 | θ = 27° | ◎ | ◎ | ○ | ○ |
| Ex. 5 | θ = 42° | ○ | ◎ | ○ | ○ |
| Ex. 6 | θ = 57° | Δ | ◎ | ◎ | Δ |

*Decision: Decreasingly favorable in order of ◎, ○, Δ.

As for ◎, ○ and Δ representing the evaluation in Table 1, ◎ represents the most high evaluation followed by other evaluations. Here, however, Δ is not to mean that the container cap cannot be used.

As the angle θ0 in the circumferential direction decreases, the capping aptitude becomes poor as in Example 2. As the angle θ increases in the circumferential direction, the contact feeling for opening improves as in Example 6 in which, however, easiness of gripping was not obtained at the time of opening and closing. Referring to Examples 3 to 5, excellent contact feeling for opening was obtained when the angle θ in the circumferential direction was in a range of not smaller than 10 degrees but not larger than 45 degrees, and the opening performance and the capping aptitude were favorable. As for the weight, the container cap of Example 6 having the greatest number of large protuberances was the heaviest as a matter of course, and Example 2 having the smallest number of large protuberances were the lightest. In Example 2, the weight of the container cap could be decreased due to the formation of small protuberances. The main portion where the small protuberances are formed has a decreased thickness and has a decreased rigidity which, however, is reinforced by the formation of the threaded portion as described above.

The invention was described above by way of embodiments. It should, however, be noted that the invention can be varied or modified in a variety of other ways without departing from the technical spirit of the invention, as a matter of course.

In the above embodiment, the small protuberance region 19 was so formed that the sizes of the small protuberances 19*a* to 19*c* were gradually decreased toward the center side so as to protrude less inward of the container cap 1 in the radial direction thereof. However, the small protuberances may have the same height of protrusion so that their ends are arranged on the same circumference.

The container cap of the invention includes large protuberance regions having a plurality of large protuberances of a large height on the main portion of the skirt wall and a small protuberance regions having a plurality of small protuberances of a smaller height than that of the large protuberances from the outer surface of the circumferential wall portion, the large protuberance regions and the small protuberance regions being alternately arranged in the circumferential direction of the main portion. Therefore, the finger tips do not slip at the time of opening or closing the container cap preventing such a contact feeling that the finger tips are bit among the protuberances even when the large protuberances and the small protuberances are strongly touched by the fingers.

By forming the small protuberances (protruding lengths of small protuberances) in two or more sizes, the difference of ruggedness decreases among the small protuberances, and improved touch feeling is offered when the protuberances of the container cap are gripped. The touch feeling of the small protuberances further improves if the height of protrusion of the small protuberances is gradually decreased from the outer side toward the middle side in the small protuberance region.

By setting the angles of the large protuberance regions and the small protuberance regions to be in a range of not smaller than 10 degrees but not larger than 45 degrees in the circumferential direction, further, the finger tips are prevented from slipping and, at the same time, such a contact feeling is prevented that the finger tips are bit by the protuberances.

Moreover, threaded portions are arranged in the inner surface of the peripheral wall of the small protuberance regions and large protuberance regions are arranged on the outer surface of the peripheral wall at portions where the screw is missing. Therefore, the resin cools uniformly at the time of forming preventing the occurrence of poor forming and maintaining balance in the strength of the container cap.

The invention claimed is:

1. A container cap comprising a top panel wall and a skirt wall of a cylindrical shape hanging down from the circumferential edge of the top panel wall, the skirt wall being sectioned into a main portion over a weakened line that is extending in the circumferential direction and can be broken and a tamper-evidence hem under the weakened line, and the circumferential wall portion of at least the main portion of the skirt wall having linear protuberances protruding on the outer side of the circumferential wall portion and extending in the up-and-down direction of the main portion in a plural number along the whole circumferential direction of the main portion, wherein the protuberances include large protuberances having a large height and small protuberances having a height of protrusion from the outer surface of the circumferential wall portion smaller than that of the large protuberances, and the main portion has large protuberance regions forming a plurality of large protuberances and small protuberance regions forming a plurality of small protuberances, the large protuberance regions and the small protuberance regions being alternately arranged in the circumferential direction of the main portion, and wherein protuberances formed on the small protuberance regions of the container cap are such that the small protuberances at positions close to the middle side of the small protuberance regions in the circumferential direction have a height of protrusion from the outer surface of the circumferential wall portion smaller than the height of protrusion of the small protuberances positioned on the outer sides.

2. The container cap according claim 1, wherein in the small protuberance regions, the height of protrusion of the small protuberances gradually decreases toward the middle side from the outer sides in the circumferential direction.

3. The container cap according to claim 1, wherein the large protuberance regions and the small protuberance regions are so arranged that the angles thereof in the circumferential direction are not smaller than 10 degrees but arc not larger than 45 degrees.

4. The container cap according to claim 1, wherein the inner surface of the circumferential wall portion of the main portion is internally threaded to come into engagement with the mouth-and-neck portion of the container, the internal thread forming a threaded portion having a screw thread and a plurality of missing portion where the screw thread is missing, the threaded portion being arranged on the inner surface of the circumferential wall portion of at least the small protuberance regions, and at least the large protuberance regions being arranged on the outer surface of the circumferential wall portion at the missing portions.

5. A container cap comprising a top panel wall and a skirt wall of a cylindrical shape hanging down from the circumferential edge of the top panel wall, the skirt wall being sectioned into a main portion over a weakened line that is extending in the circumferential direction and can be broken and a tamper-evidence hem under the weakened line, and the circumferential wall portion of at least the main portion of the skirt wall having linear protuberances protruding on the outer side of the circumferential wall portion and extending in the up-and-down direction of the main portion in a plural number along the whole circumferential direction of the main portion, wherein the protuberances include large protuberances having a large height and small protuberances having a height of protrusion from the outer surface of the circumferential wall portion smaller than that of the large protuberances, and the main portion has large protuberance regions forming a plurality of large protuberances and small protuberance regions forming a plurality of small protuberances, the large protuberance regions and the small protuberance regions being alternately arranged in the circumferential direction of the main portion, and wherein the inner surface of the circumferential wall portion of the main portion is internally threaded to come into engagement with the mouth-and-neck portion of the container, the internal thread forming a threaded portion having a screw thread and a plurality of missing portion where the screw thread is missing, the threaded portion being arranged on the inner surface of the circumferential wall portion of at least the small protuberance regions, and at least the large protuberance regions being arranged on the outer surface of the circumferential wall portion at the missing portions.

6. The container cap according to claim 5, wherein in the small protuberance regions, the height of protrusion of the small protuberances gradually decreases toward the middle side from the outer sides in the circumferential direction.

7. The container cap according to claim 5, wherein the large protuberance regions and the small protuberance regions are so arranged that the angles thereof in the circumferential direction are not smaller than 10 degrees but arc not larger than 45 degrees.

* * * * *